US006908040B2

(12) United States Patent
Dong et al.

(10) Patent No.: US 6,908,040 B2
(45) Date of Patent: Jun. 21, 2005

(54) UNIT INJECTOR WITH STABILIZED PILOT INJECTION

(75) Inventors: Mingchun Dong, Bloomington, IL (US); Avtar S. Sandhu, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 39 days.

(21) Appl. No.: 10/411,808

(22) Filed: Apr. 11, 2003

(65) Prior Publication Data

US 2004/0217206 A1 Nov. 4, 2004

(51) Int. Cl.[7] ..... F02D 1/06

(52) U.S. Cl. ..... 239/5; 239/88; 239/91; 239/92; 239/124; 239/533.2; 123/446

(58) Field of Search ..... 239/88, 89, 90, 239/91, 92, 93, 124, 533.2, 533.4, 5; 123/446

(56) References Cited

U.S. PATENT DOCUMENTS 4,129,255 A * 12/1978 Bader et al. ..... 239/96
4,396,151 A * 8/1983 Kato et al. ..... 239/89
4,653,448 A * 3/1987 Ohmori et al. ..... 123/446
5,494,220 A 2/1996 Shinogle et al.

* cited by examiner

*Primary Examiner*—Dinh Q. Nguyen
(74) *Attorney, Agent, or Firm*—J. W. Burrows

(57) ABSTRACT

A unit injector assembly is provided that helps to ensure maximum injection flow while minimizing the harmful affects of pressure waves within the unit injector assembly. The unit injector assembly has a first fuel passageway extending from the plunger piston pumping chamber to the tip check stem injection chamber and valve seat. The unit injector assembly has a second fuel passageway extending from the tip check stem injection chamber to a fuel control valve assembly. A flow restricting fuel passageway connects one of the pumping chamber and the first fuel passageway with the second fuel passageway and acts to minimize cavitation at the valve seat and effectively eliminates pressure waves within the unit injector assembly.

10 Claims, 2 Drawing Sheets

UNIT INJECTOR WITH STABILIZED PILOT INJECTION

TECHNICAL FIELD

This invention relates generally to a unit fuel injector for an internal combustion engine and more particularly to a unit injector having a stabilized pilot injection.

BACKGROUND

Unit fuel injectors are well known in the art for controlling the timing and volume of fuel being injected into respective combustion chambers of an engine. Typically, many of these unit injectors are mechanically or hydraulically actuated. In most applications currently used, the timing of the respective injections are controlled electronically based on various system parameters. In one example of these known unit injectors, fuel is delivered to a pumping chamber through an electrically controlled valve assembly and a plunger piston acts in response to rotation of a cam arrangement moving the plunger piston to force the fuel from the pumping chamber. When the electrically controlled valve assembly is closed, the fuel is forced towards a pressure responsive check valve and subsequently to a fuel nozzle for injection into the combustion chamber of the engine. When the electrically controlled valve is open during the movement of the plunger piston, the fuel is forced to flow back into the low-pressure fuel gallery. In many of these known systems, unstable pilot injection may occur. These unstable pilot injections may be a result of fluctuations in the pressure in the system due to the fluid dynamics therein. An example of such as system is illustrated in U.S. Pat. No. 5,494,220 which issued on Feb. 27, 1996 to R. D. Shinogle et al. This patent attempts to offset pressure variations around the periphery of the valve seat in order to prevent or minimize weakening of the fluid seal at the valve seat. The pressure variations are typically a result of sudden changes in fluid flow within the unit injector that result in undesirable pressure fluctuation (spikes). Likewise, these pressure spikes may also cause cavitation at the nozzle tip during injection of fuel into the combustion chamber.

The subject invention is directed to overcoming one or more of problems as set forth above.

SUMMARY OF THE INVENTION

In one aspect of the subject invention, a unit injector assembly is provided for controllably delivering fuel to a combustion chamber of an engine. The unit injector assembly includes an injector body having a plunger piston bore and an injection chamber bore defined therein. A valve assembly is disposed in the injector body and is selectively movable between a flow passing position and a flow blocking position. A plunger assembly is disposed in the injector body and has a plunger piston disposed in the plunger piston bore of the injector body to define a pumping chamber therein. An injector tip assembly is disposed in the injector body and has a tip check stem disposed in the injection chamber bore of the injector body and operative to control the flow of injection fuel from the injection chamber bore to the combustion chamber. A first fuel passageway is defined in the injector body between the pumping chamber and the injection chamber bore and a second fuel passageway is defined in the injector body between the injection chamber bore and the valve assembly. A flow restricting fuel passageway is defined in the injector body interconnecting the first and second fuel passageways.

In another aspect of the present invention, a method is provided for controlling pressure spikes in a unit injector assembly. The method includes the step of providing a plunger assembly connected to an injector tip assembly through a first fuel passageway; providing a valve assembly connected to the injector tip assembly through a second fuel passageway; and providing a flow restricting fuel passageway between the first and second fuel passageways.

DETAILED DESCRIPTION

Figure 1:
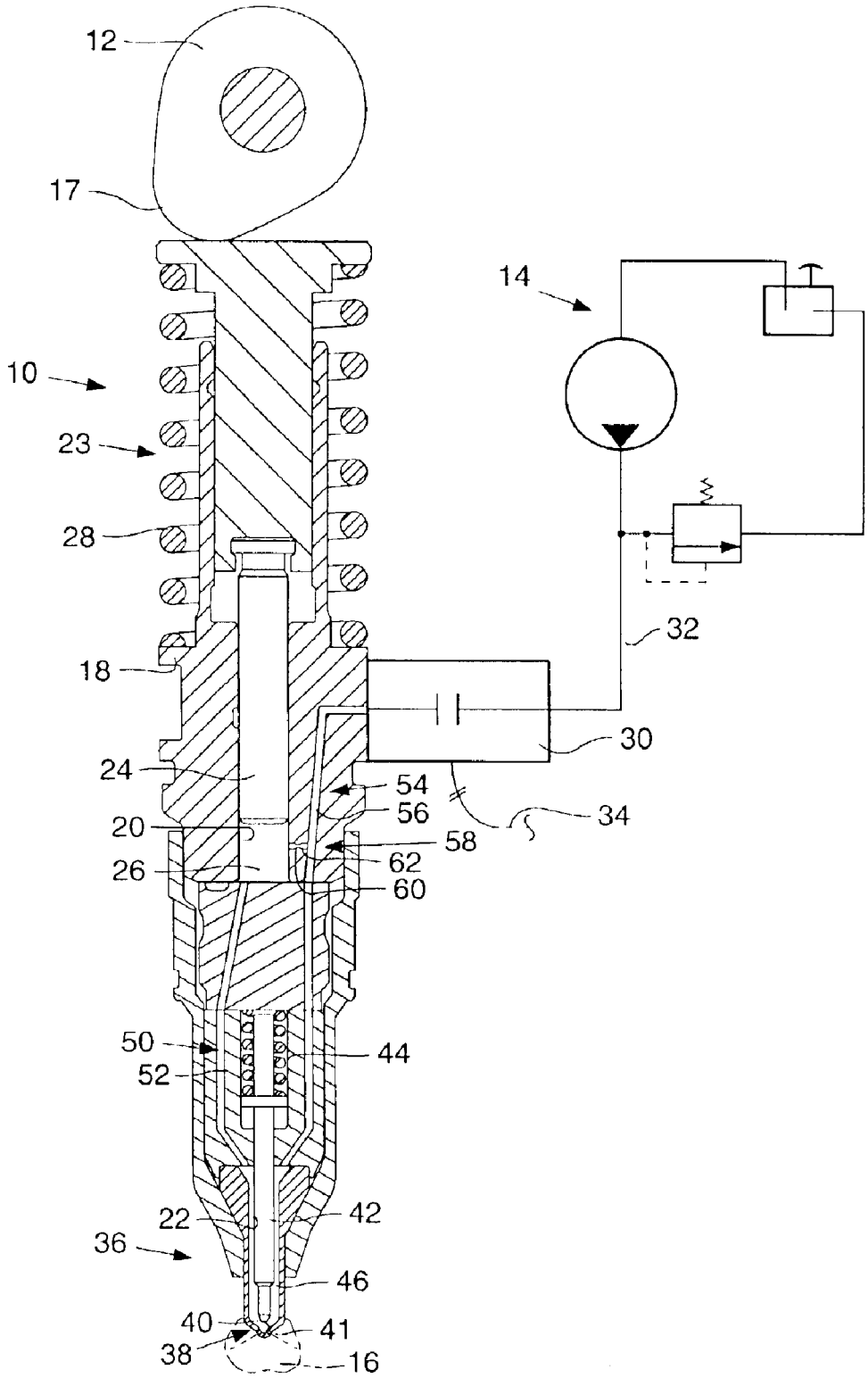
FIG. 1 is a partial diagrammatic and partial schematic representation of an embodiment of the subject invention in one mode of operation.
Figure 2:
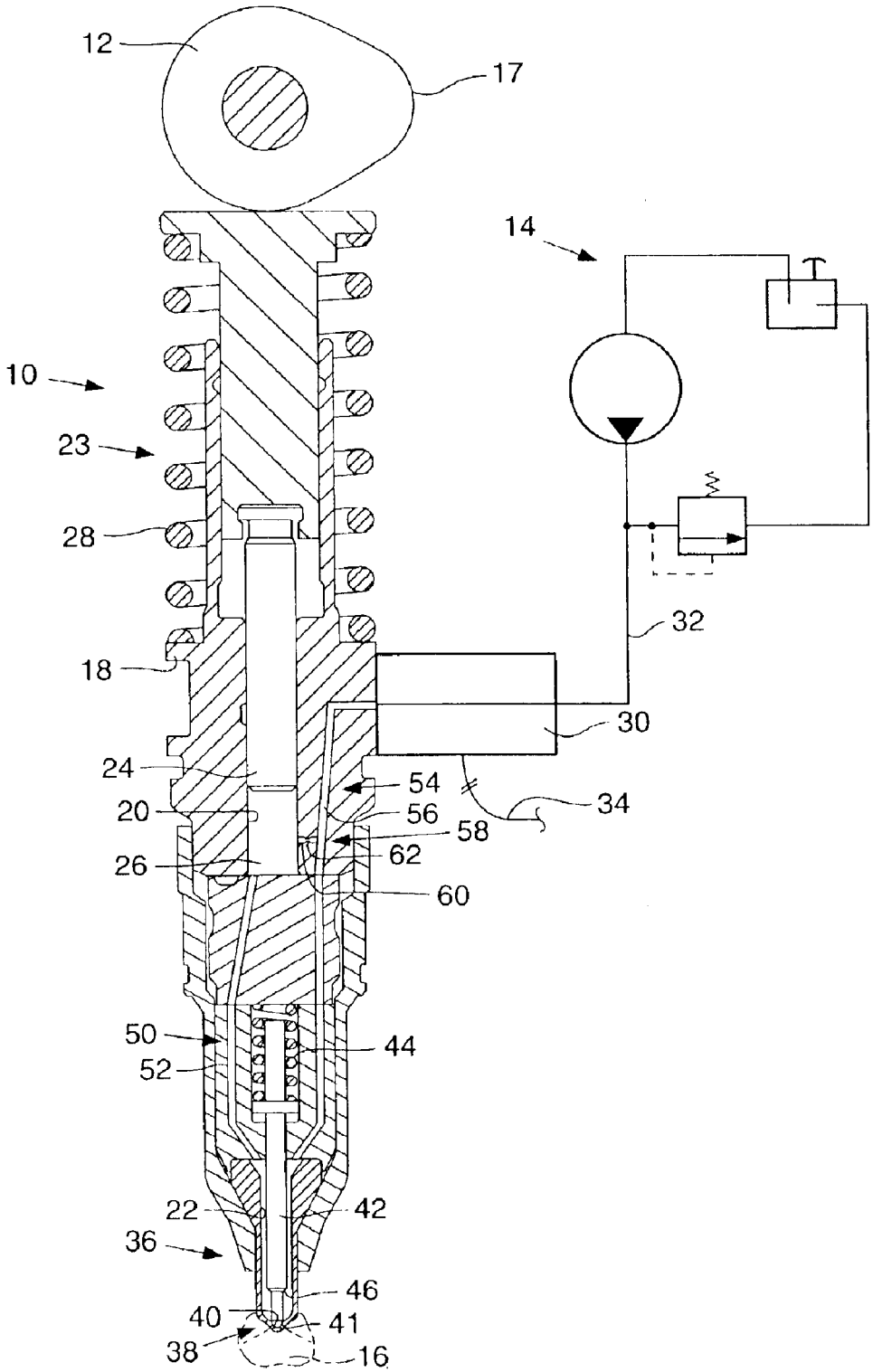
FIG. 2 is a partial diagrammatic and partial schematic representation of the embodiment of the subject invention in another mode of operation.

Referring to FIGS. 1 & 2, a unit injector assembly 10 is illustrated in cooperation with a cam arrangement 12 of an engine (not shown), a source of fuel 14, and a combustion chamber 16 of the engine (not shown). The cam arrangement 12, in a well known manner, has a cam lobe 17 disposed thereon.

The unit injector assembly 10 includes an injector body 18 having a plunger piston bore 20 and an injection chamber bore 22 defined therein. A plunger assembly 23 has a plunger piston 24 that is slideably disposed in the plunger piston bore 20 and defines a pumping chamber 26 in the plunger piston bore 20. The plunger piston 24 extends from the injector body 18 and is in mating contact with the cam arrangement 12. The plunger piston 24 is biased towards the cam arrangement by a spring 28. It is recognized that the plunger piston 24 could be composed of two or more elements without departing from the essence of the subject invention.

A valve assembly 30 is operatively disposed in the injector body 18 and is connected to the source of fuel 14 by a conduit 32. The valve assembly 30 is selectively movable between a closed, flow blocking position, as shown in FIG. 1 and an open, flow passing position, as illustrated in FIG. 2. The valve assembly 30 is movable, in a known manner, between its open and closed position in response to an electrical signal delivered through an electrical line 34. It is recognized that the valve assembly 30 could be separate from the injector body 18 and connected to the injector body 18 VIA a conduit (not shown).

An injector tip assembly 36 is disposed in the injector body 18 and includes a nozzle tip 38 disposed in the injector body 18. The nozzle tip 38 has a valve seat 40 disposed at one end of the injection chamber bore 22. A plurality of passages 41 are defined in the nozzle tip 38 between the valve seat 40 and the combustion chamber 16. A tip check stem 42 is disposed in the injection chamber bore 22 and is biased by a spring 44 towards the valve seat 40. A differential area 46 is defined on a portion of the tip check stem 42 within the injection chamber bore 22. In a well known manner, the differential area 46 is operative, in response to pressurized fuel in the injection chamber bore 22, to urge the tip check stem 42 away from the valve seat 40 against the bias of the spring 44.

A first fuel passageway 50 is defined in the injector body 18 by a first passage 52 that is disposed between the pumping chamber 26 and the injection chamber bore 22. A second fuel passageway 54 is defined in the injector body 18 by a second passage 56 that is disposed between the valve assembly 30 and the injection chamber bore 22.

A flow restricting fuel passageway 58 is defined in the injector body 18 by a connecting passage 60 that is disposed between the pumping chamber 26 and the second passage 56. The connecting passage 60 has an orifice 62 disposed therein. It is recognized that the flow restricting fuel passageway 58 could also be connected between the first and second passageways 50, 54 without departing from the essence of the subject invention. It is recognized that the connecting passage 60 could be of a size sufficient to provide the needed flow restriction without having to provide the orifice 62.

It is recognized that the subject invention could be utilized in various injector valve arrangements without departing from the essence of the subject invention. For example, the fuel being supplied to the pumping chamber 26 could be supplied directly to the pumping chamber without going through the valve assembly 30. In this type of arrangement, the fuel is directed to the pumping chamber 26 through another conduit having a one-way check valve therein. Likewise, in other fuel injector assemblies, the tip check stem 42 of the subject disclosure could be replaced with a direct-operated check valve (needle valve) in which the needle valve is directly controlled and not controlled by the injection pressure within the injection chamber bore 22. Other possible ways of utilizing the subject invention would be known to one skilled in the art.

INDUSTRIAL APPLICABILITY

The unit injector assembly 10 of FIG. 1 is illustrated in its fuel injection mode of operation with the valve assembly 30 in its flow blocking position. As the cam lobe 17 engages the plunger piston 24, the plunger piston 24 is moved against the bias of the spring 28 and forces fuel from the pumping chamber 26. Prior to the lifting portion of the cam lobe 17 engaging the plunger piston 24, the valve assembly 30 is in its flow passing position, as illustrated in FIG. 2. With the valve assembly 30 open, fuel from the source of fuel 14 is delivered through the valve assembly 30, the second fuel passageway 54, the injection chamber bore 22, and the first fuel passageway 50 to the pumping chamber 26. The valve assembly 30 is closed prior to the lifting portion of the cam lobe 17 contacting the plunger piston 24. As the cam lobe 17 urges the plunger piston 24 against the bias of the spring 28, fuel is forced through the first fuel passageway 50 into the injection chamber bore 22. Since the valve assembly 30 is in its flow blocking position, the pressure of the fuel within the injection chamber bore 22 quickly increases. The pressurized fuel in the injection chamber bore 22 acts on the differential area 46 of the tip check stem 42 creating a force that urges the tip check stem 22 against the bias of the spring 44.

Once the force being generated by the pressurized fuel acting on the differential area 46 of the tip check stem 42 reaches a predetermined value, the tip check stem 42 moves away from the valve seat 40. The predetermined value of the force is reached when the pressure in the injection chamber bore 22 acting on the differential area 46 overcomes the force of the spring 44. As the tip check stem 42 moves away from the valve seat 40, fuel is passed therethrough and injected across the plurality of passages 41 into the combustion chamber 16.

Due to the overall length of the first and second fuel passageways 50,54, pressure fluctuations (spikes) may occur within the injection chamber bore 22. These pressure fluctuations may cause the tip check stem 42 to operate in an erratic manner by opening and closing prematurely during the injection mode. Such pressure fluctuations can result in cavitation of the fuel at the valve seat 40. Pressure fluctuations in the injection chamber bore 22 are primarily offset by the flow restricting fuel passageway 58 interconnecting one of the pumping chamber 26 and the first fuel passageway 50 with the second fuel passageway 54. The restricted flow of fuel across the flow restricting fuel passageway 58 acts to more quickly pressurize the fuel in the second fuel passageway 54. This eliminates the tendency of a pressure wave (water hammer effect) being generated within the first and second fuel passageways 50,54 and the injection chamber bore 22. The pressure wave (increase and decrease in pressure) tends to move back and forth within the first and second fuel passageways 50,54 and the injection chamber bore 22. This event causes the tip check stem 42 to become erratic and bounce which adversely affects the quality of the injection cycle.

Once the cam lobe 17 permits the plunger piston 24 to retract, the pressure in the injection chamber bore 22 quickly reduces and the force of the spring 44 urges the tip check stem 42 against the valve seat 40 thus closing the fuel injection cycle. At the same time, the valve assembly 30 is moved to its flow passing position. With the valve assembly 30 in the flow passing position, fuel is once again delivered through the first and second fuel passageways 54,50 to fill the pumping chamber 26 as the plunger piston 24 retracts. At the close of the fuel injection cycle, the flow restricting passageway 58 ensure that the tip check stem 42 quickly and positively seats against the valve seat 40 by providing an additional path of fuel flow to more quickly reduce the pressurized fuel in the pumping chamber 26.

From the foregoing, it is readily apparent that the subject unit injector assembly 10 provides maximum injection flow to the combustion chamber 16 free of cavitation at the valve seat 40 while maintaining stable, consistent movement of the tip check stem 42.

Other aspects, objects and advantages of the invention can be obtained from a study of the drawings, the disclosure and the appended claims.

What is claimed is:

1. A unit injector assembly for injecting fuel into a combustion chamber of an engine, the unit injector assembly comprises:

an injector body defining a plunger piston bore and an injection chamber bore therein;

a valve assembly selectively movable between a flow passing position and a flow blocking position;

a plunger assembly having a plunger piston, the plunger piston being disposed in the plunger piston bore of the injector body to define a pumping chamber in the injector body;

an injector tip assembly having a tip check stem, the tip check stem being disposed in the injection chamber bore of the injector body and operative to control the flow of injection fuel from the injection chamber bore;

a first fuel passageway defined in the injector body between the pumping chamber and the injection chamber bore;

a second fuel passageway defined in the injector body between the injection chamber bore and the valve assembly;

a flow restricting fuel passageway defined in the injector body continuously interconnecting one of the pumping chamber and the first fuel passageway with the second fuel passageway.

2. The unit injector assembly of claim 1 wherein the flow restricting fuel passageway includes a connecting passage having an orifice disposed therein.

3. The unit injector assembly of claim 1 wherein the flow restricting fuel passageway interconnects the pumping chamber with the second fuel passageway.

4. The unit injector assembly of claim 1 wherein the injector tip assembly includes a nozzle tip having a valve seat at one end of the injection chamber bore and the tip check stem is disposed in the injection chamber bore and is operative to engage the valve seat.

5. The unit injector assembly of claim 4 wherein a differential area is defined on the tip check stem within the injection chamber bore and operative when in use to urge the tip check stem away from the valve seat.

6. The unit injector assembly of claim 1 in combination with a cam arrangement, the plunger piston of the plunger assembly is in operative engagement with the cam arrangement and is spring biased in a direction towards the cam arrangement.

7. The unit injector assembly of claim 1 in combination with a source of fuel and the valve assembly is operatively connected to the source of fuel.

8. A method for controlling pressure spikes in a unit injector assembly, the method includes the step of:

providing a plunger assembly having a pumping chamber connected to an injector tip assembly through a first fuel passageway;

providing a valve assembly connected to the injector tip assembly through a second fuel passageway; and providing a flow restricting fuel passageway for continuously connecting one of the pumping chamber and the first fuel passageway with the second fuel passageway.

9. The method of claim 8 wherein in the step of providing a flow restricting fuel passageway, the flow restricting fuel passageway is connected between the pumping chamber and the second fuel passageway.

10. The method of claim 8 wherein in the step of providing a flow restricting fuel passageway includes providing a connecting passageway between the first and second fuel passageways and disposing an orifice therein.

* * * * *